US009899741B2

(12) United States Patent
Roulston et al.

(10) Patent No.: US 9,899,741 B2
(45) Date of Patent: Feb. 20, 2018

(54) RADIO FREQUENCY ANTENNA

(71) Applicant: RODradar Ltd., Rinatya (IL)

(72) Inventors: John Francis Roulston, Edinburgh (GB); Ely Levine, Rehovot (IL); Haim Matzner, Petach Tikva (IL)

(73) Assignee: RODRADAR LTD., Rinatya (IL)

( * ) Notice: Subject to any disclaimer, the term of this patent is extended or adjusted under 35 U.S.C. 154(b) by 125 days.

(21) Appl. No.: 14/604,777

(22) Filed: Jan. 26, 2015

(65) Prior Publication Data

US 2016/0218423 A1 Jul. 28, 2016

(51) Int. Cl.
*H01Q 1/42* (2006.01)
*H01Q 13/18* (2006.01)

(52) U.S. Cl.
CPC ..... *H01Q 13/18* (2013.01)

(58) Field of Classification Search
CPC ..... H01Q 13/10; H01Q 13/18; H01Q 1/42
USPC ..... 767/789, 705, 711, 718, 767, 841
See application file for complete search history.

(56) References Cited

U.S. PATENT DOCUMENTS

| | | | | |
|---|---|---|---|---|
| 5,914,693 | A | 6/1999 | Takei et al. | |
| 6,421,018 | B1 * | 7/2002 | Zeilinger | H01Q 1/1285 343/713 |
| 2007/0080878 | A1 | 4/2007 | McLean | |
| 2007/0194999 | A1 | 8/2007 | Morton | |
| 2009/0237263 | A1 * | 9/2009 | Sawyer, Jr. | G01S 19/14 340/686.6 |
| 2015/0085184 | A1 * | 3/2015 | Vidal | H04N 5/2252 348/376 |

FOREIGN PATENT DOCUMENTS

| | | | | |
|---|---|---|---|---|
| JP | 1995307612 | | 11/1995 | |
| JP | 2010-109623 | * | 5/2010 | H01Q 13/10 |
| JP | 2010109623 | | 5/2010 | |
| JP | 4891698 | | 3/2012 | |
| KR | 2001096957 | | 11/2001 | |

OTHER PUBLICATIONS

Section III.B of "Antenna Theory: A Review," Constantine A. Balanis, Proceedings of the IEEE, vol. 80, No. 1, Jan. 1992.*
International Search Report for application PCT/IL2016/050072 dated May 23, 2016.

* cited by examiner

*Primary Examiner* — Jessica Han
*Assistant Examiner* — Jae Kim
(74) *Attorney, Agent, or Firm* — Heidi Brun Associates Ltd.

(57) ABSTRACT

A radio frequency (RF) antenna that may include a hollow enclosure made of a conductive material; wherein a first portion of the hollow enclosure has a bow tie shaped slot; a conductor that is spaced apart from the slot, is positioned within a cavity defined by the hollow enclosure, and is electrically isolated from the hollow enclosure; a first port that is coupled to the conductor; and a dielectric element that is made of dielectric material that at least partially fills the cavity and the bow tie shaped slot; wherein the conductor is configured to perform at least one operation out of: (a) receive, via the cavity, received RF radiation and send a received RF signal to the first port; (b) receive, from the first port, a transmitted RF signal and radiating transmitted RF radiation via the cavity.

17 Claims, 14 Drawing Sheets

40

RADIO FREQUENCY ANTENNA

FIELD OF THE INVENTION

The present invention relates to a radio frequency (RF) antenna.

BACKGROUND

Many radio frequency (RF) based applications, and especially those related to ground penetration radars (GPR), underwater radars and underwater communication, involve antennas which are required to meet RF specifications, e.g., wide frequency range and gain, while maintaining small dimensions and resistance to extreme environmental conditions.

Environmental conditions might include extreme pressure, shock, vibrations, bending moment, shear and temperature, which are common in applications when the antenna is attached, for example, to moving parts of machinery. In some applications temperature extreme is experienced as well as exposure to non-solid materials such as soil and water.

Therefore, there is a growing need to provide an antenna solution which allows radio and radar technique to be used in extreme environments.

SUMMARY

According to an embodiment of the invention there may be provided a radio frequency (RF) antenna, which may include: a hollow enclosure or cavity made of a conductive material; wherein a first portion of the hollow enclosure has a bow tie shaped slot; a conductor that is spaced apart from the slot, is positioned within a cavity defined by the hollow enclosure, and is electrically isolated from the hollow enclosure; a first port that is coupled to the conductor; and a dielectric element that is made of dielectric material that at least partially fills the cavity and the bow tie shaped slot; wherein the conductor is configured to perform at least one operation out of: (a) receive, via the cavity, received RF radiation and send a received RF signal to the first port; (b) receive, from the first port, a transmitted RF signal and radiating transmitted RF radiation via the cavity.

The first port may include a core that is coupled to the conductor and a shield that is coupled to the hollow enclosure.

The first port may be configured to be coupled to a RF feed without a balun.

The RF antenna may not include a balun.

The conductor may have a longitudinal axis; wherein a cross section of the conductor may change (by shape and/or size) along at least a portion of the longitudinal axis.

The conductor may have a longitudinal axis; wherein a cross section of the conductor may gradually change along at least a portion of the longitudinal axis.

The conductor may have an elliptical cross section, a polygon cross section, a planar cross-section or any other shape.

The bow tie shaped slot may have a longitudinal axis and a transverse axis of symmetry; wherein a trajectory of the conductor on the bow tie shaped slot overlaps the transverse axis of symmetry of the bow tie shaped slot.

The bow tie shaped slot may have a longitudinal axis that may be perpendicular to a longitudinal axis of the conductor.

The bow tie shaped slot may have a longitudinal axis that may be oriented in relation to a longitudinal axis of the conductor.

The dielectric material partly or completely fills the cavity and the bow tie shaped slot.

The thickness of the first portion of the hollow aperture that defined the bow tie shaped slot may be about one tenth of a wavelength of a RF signal transmitted by the RF antenna.

The RF antenna may include an antenna monitor that may be arranged to monitor at least one out of a location of the RF antenna, a velocity of the RF antenna and an acceleration of the RF antenna and roll pitch and yaw angles of the antenna.

The RF antenna may include an antenna monitor that may be positioned within the cavity or outside the cavity but rigidly connected to the cavity.

The RF antenna may include an antenna monitor that may be an attitude and heading reference system or an attitude heading reference system.

The hollow enclosure may be a part of a digging element arranged to dig materials.

The hollow enclosure may be made of a durable material. It may withstand forces applied during a digging of ground or other medium.

According to an embodiment of the invention there may be provided a method for transmitting radio frequency (RF) radiation, the method may include: feeding a conductor of the RF antenna with a transmitted RF signal; wherein the RF antenna may include (a) a hollow enclosure made of a conductive material; wherein a first portion of the hollow enclosure may have a bow tie shaped slot (c) the conductor, wherein the conductor may be spaced apart from the slot, may be positioned within a cavity defined by the hollow enclosure, and may be electrically isolated from the hollow enclosure; (d) a first port that may be coupled to the conductor; and (e) a dielectric element that may be made of dielectric material that at least partially fills the cavity and the bow tie shaped slot; and radiating by the conductor transmitted RF radiation via the cavity.

According to an embodiment of the invention there may be provided a method for transmitting radio frequency (RF) radiation, the method may include: receiving, by a conductor and via a bow tie shaped slot and a cavity of a hollow enclosure of an RF antenna, received RF radiation; wherein the RF antenna may include (a) the hollow enclosure, wherein the hollow enclosure may be made of a conductive and durable material; wherein a first portion of the hollow enclosure may have the bow tie shaped slot; (c) the conductor, wherein the conductor may be spaced apart from the slot, may be positioned within the cavity, and may be electrically isolated from the hollow enclosure; (d) a first port that may be coupled to the conductor; and (e) a dielectric element that may be made of dielectric material that at least partially fills the cavity and the bow tie shaped slot; and sending, by the conductor, a received RF signal to the first port.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE DRAWINGS

Figure 1:
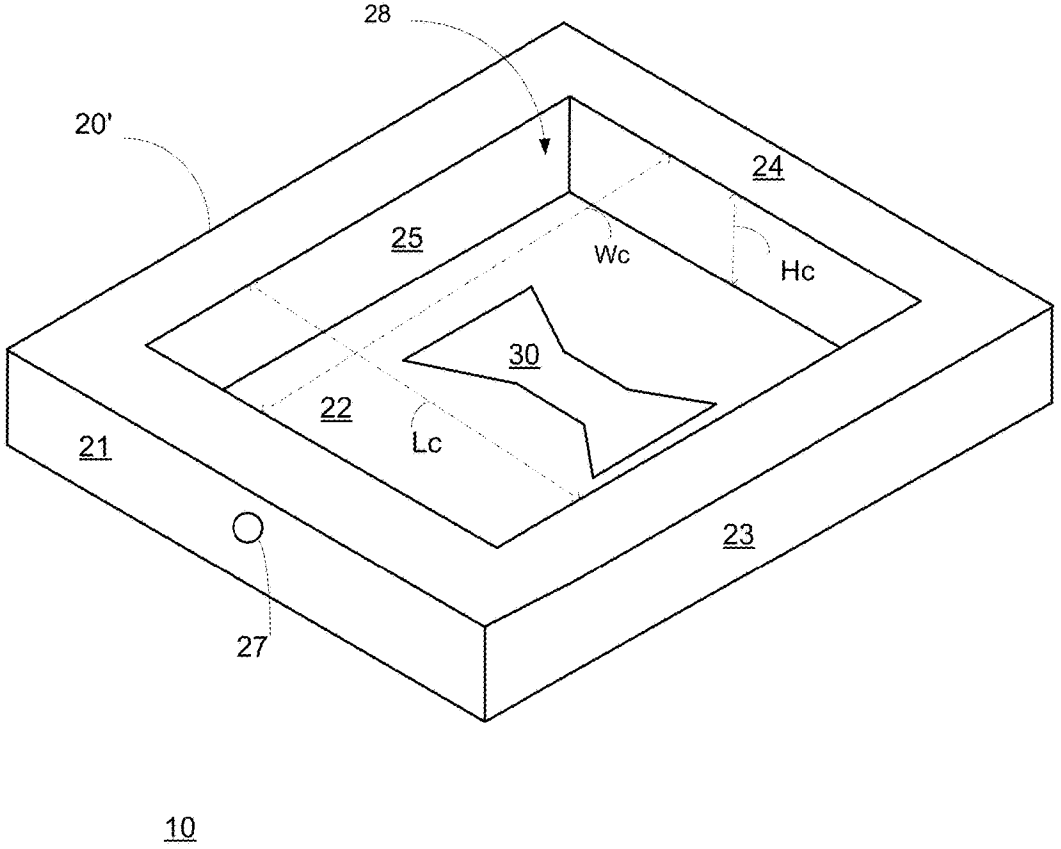
FIG. 1 illustrates portion of a hollow enclosure of a RF antenna according to an embodiment of the invention.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference in the specification to a method should be applied mutatis mutandis to a system capable of executing the method.

Any reference in the specification to a system should be applied mutatis mutandis to a method that may be executed by the system.

According to an embodiment of the invention there is provided an RF antenna suitable for deployment in conditions of extreme mechanical shock, pressure, force, moment and temperature while at the same time providing high fractional bandwidth and capable of scaling over a wide range of center frequencies.

The RF antenna may be used for GPR applications, which operates in a broad range of frequencies at the UHF and L-band (0.3 to 2 GHz), with bandwidth larger than 50%, and is resistant to extreme environmental conditions. The design is scalable to at least Ku band and demonstrates radiation properties which facilitate efficient matching into free-space or dielectric such as typical soil. The RF antenna is capable of handling high peak power levels without breakdown.

The RF antenna is shaped and sized to provide both a large bandwidth, compact size and durability. Especially—using a bow tie shaped slot provides a large bandwidth, the filling of the cavity of the hollow enclosure of the RF antenna with dielectric antenna reduces the dimensions of the RF antenna, and the hollow enclosure of the RF antenna (as well as filling the slot and the hollow cavity with dielectric cavity) provides a durable RF antenna. This RF antenna may be integrated as part of a machine, and especially as part of a bucket of a digger, thereby using the same material as the digger, reducing the cost of manufacturing and increasing resistance to environmental conditions.

Furthermore, as is described later, the RF antenna employs a novel feeding technique which avoids the need for a balun and employs a conductor (conductor) with a cross-section that may be circular, elliptical or of other geometry, with no direct contact to the slot, in a way that optimally feeds the slot over a wide frequency range.

To assist the processing of signals from the antenna while installed on a moving part such as a bucket of a digger, the RF antenna may be equipped with a motion sensing module which reports the antenna space trajectory parameterized by a time variable so that the instantaneous position of the RF antenna may be registered for the purpose of constructing a synthetic array by processing means. The proposed design enables encapsulating the motion sensing module within the RF antenna so that the design is compact.

The RF antenna may be designed to be part of a bucket of a digger without constraining the digging operation, therefore, the RF antenna is compact so that the dimensions of the bucket will not be significantly affected. To this end, the suggested RF antenna (being a slot antenna) is preferred over dipole antenna and unbalanced feed is preferred over balanced one.

Figure 4:
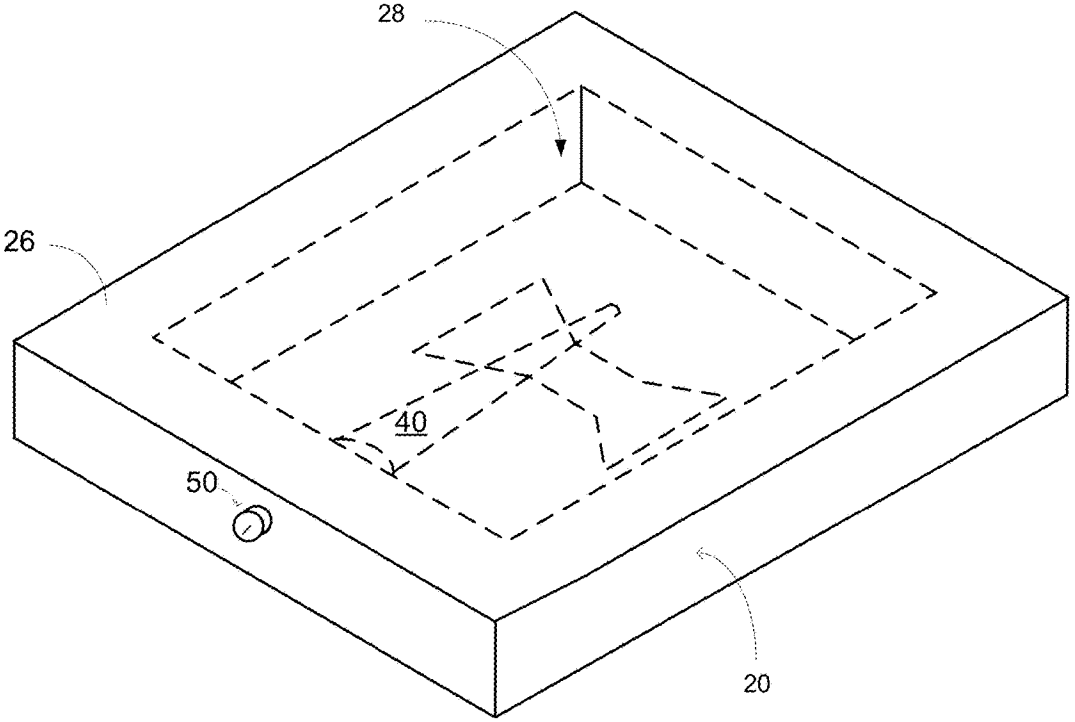
FIG. 4 illustrates a RF antenna according to an embodiment of the invention.
Figure 5:
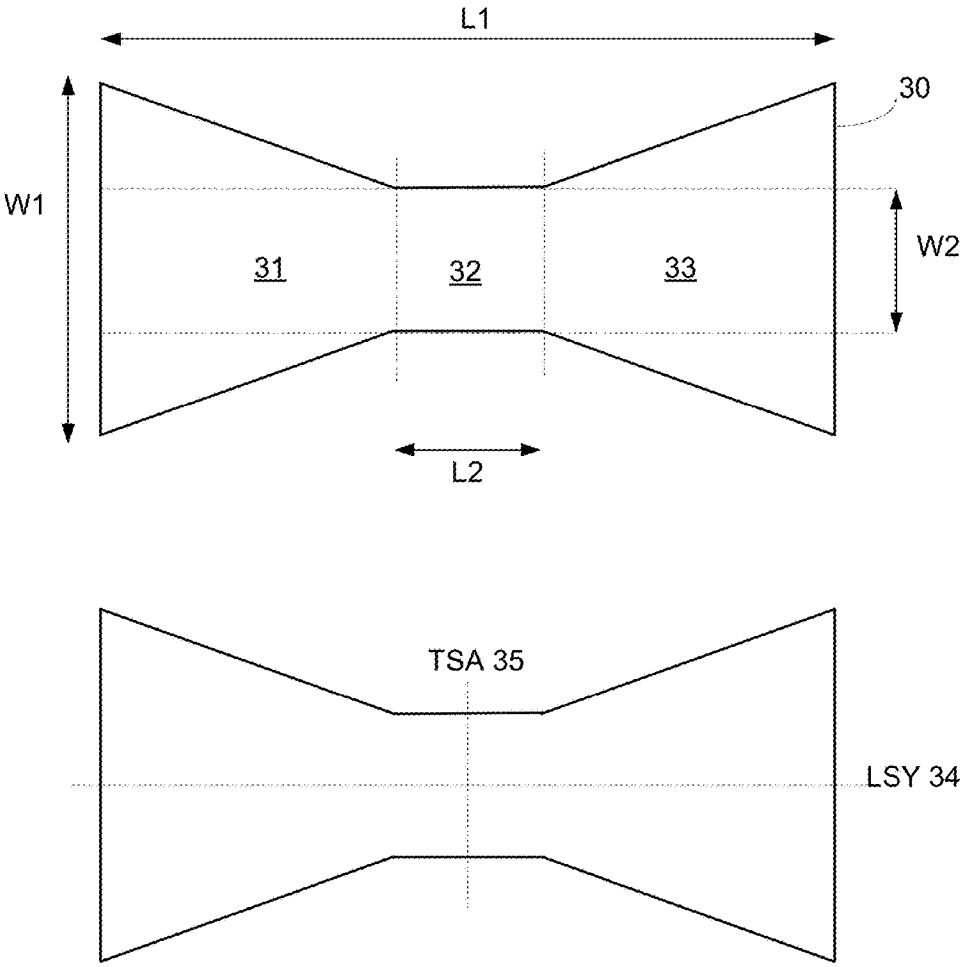
FIG. 5 illustrates a bow tie shaped slot form in a first portion of the hollow enclosure according to an embodiment of the invention.
Figure 6:
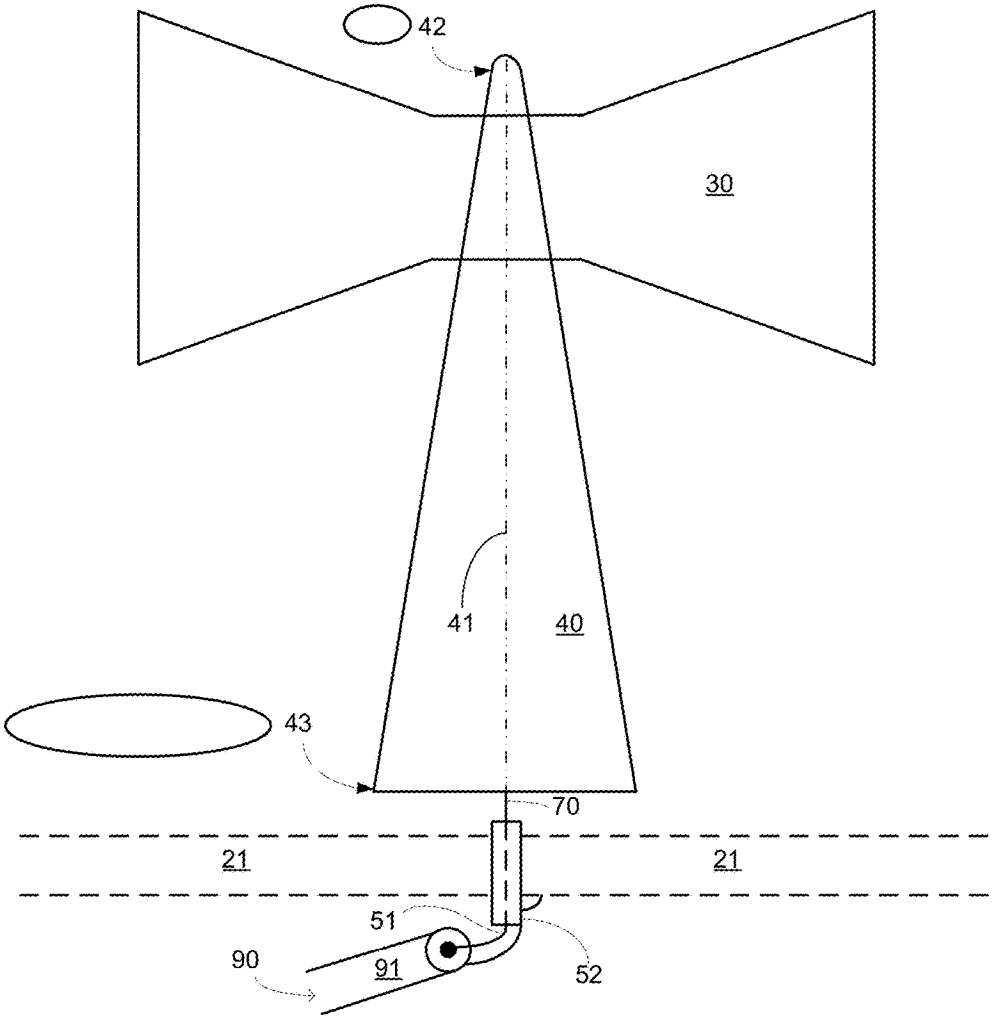
FIG. 6 illustrates a coaxial cable and a portion of a RF antenna according to an embodiment of the invention.
Figure 7:
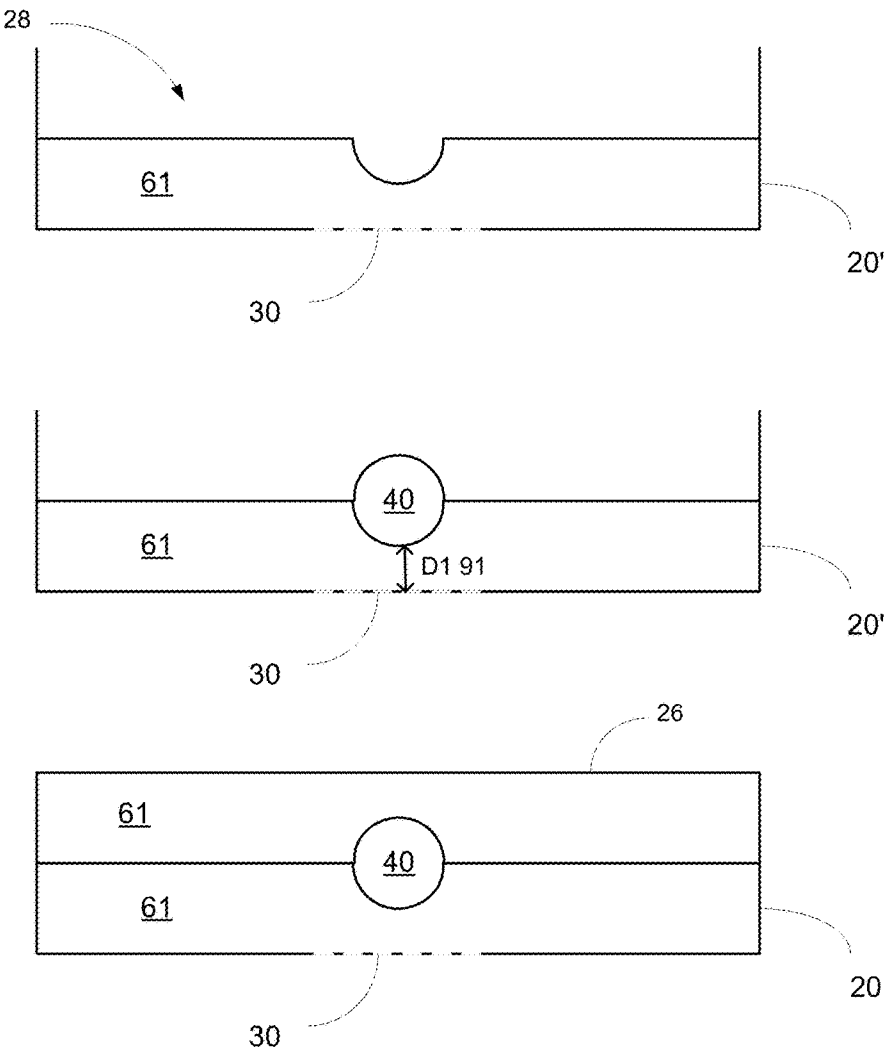
FIG. 7 illustrates an assembly process of a RF antenna according to an embodiment of the invention.
Figure 8:
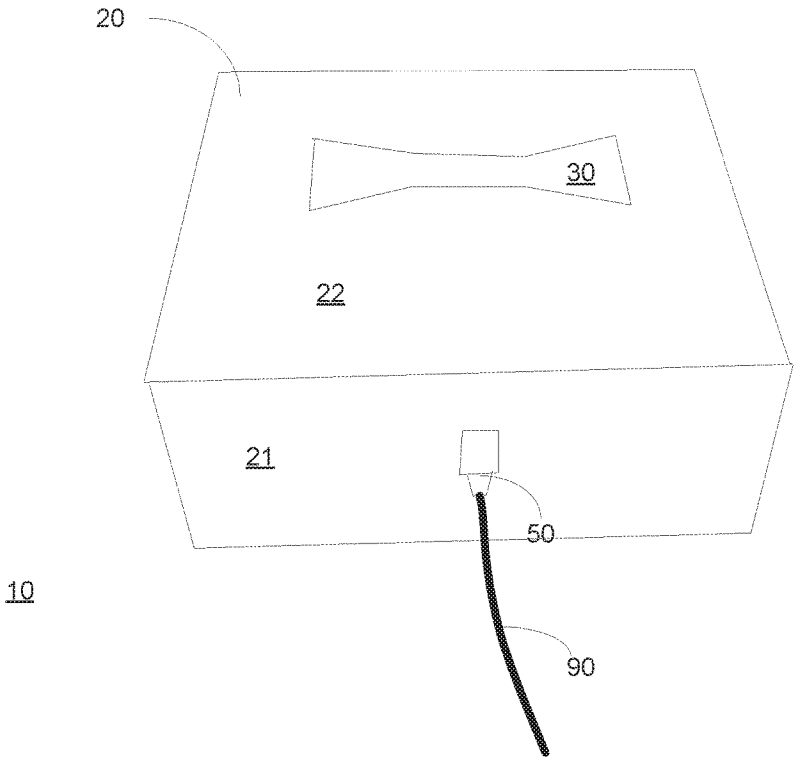
FIG. 8 illustrates a coaxial cable and a RF antenna according to an embodiment of the invention.
Figure 9:
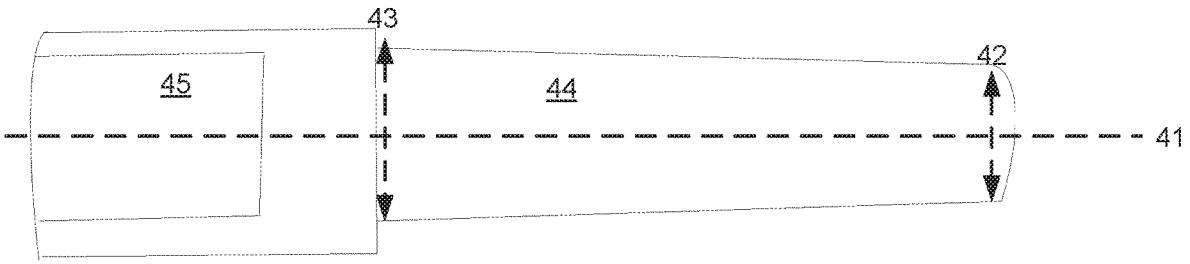
FIG. 9 illustrates a conductor of a RF antenna according to an embodiment of the invention.
Figure 10:
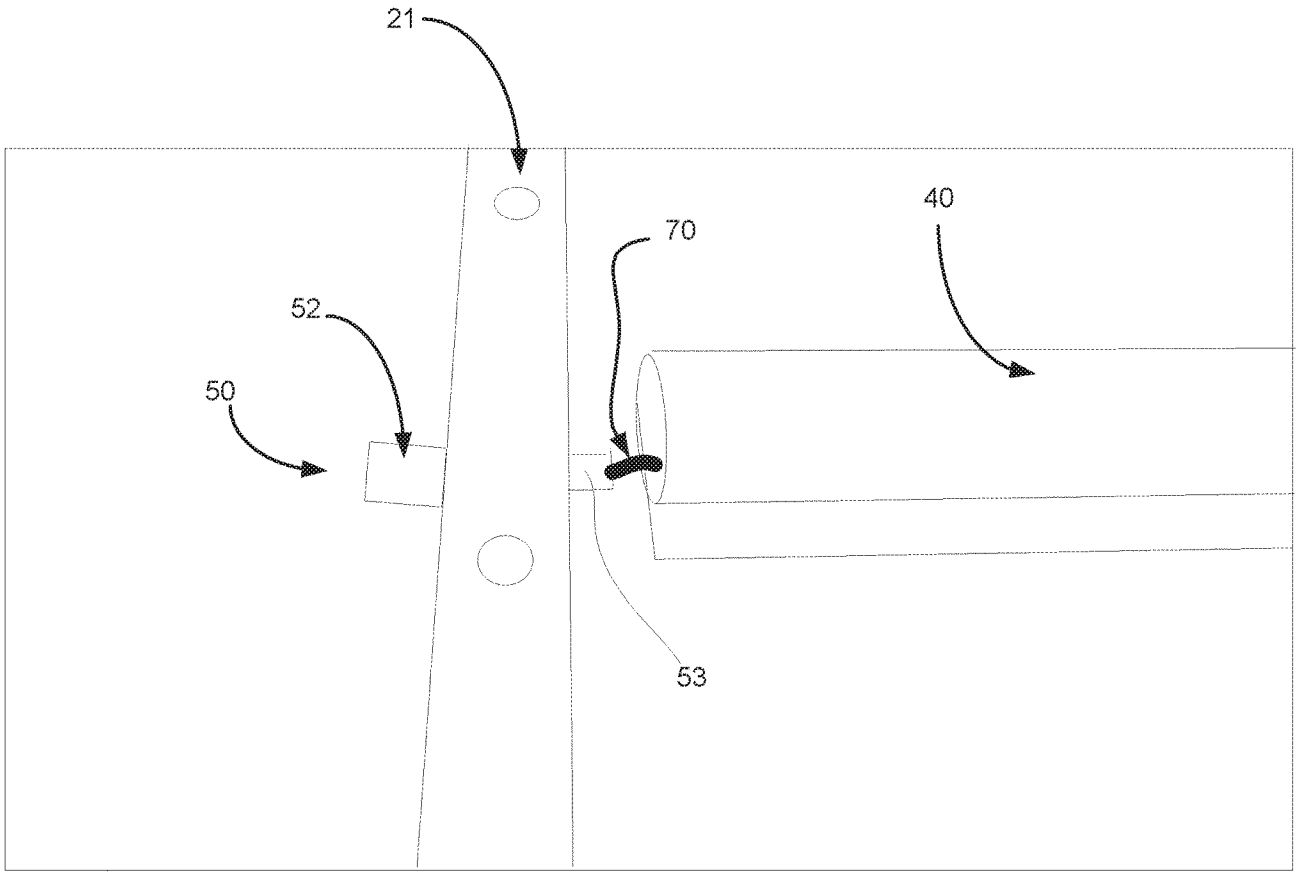
FIG. 10 illustrates portion of a RF antenna that includes a portion of the hollow enclosure, a first port and a conductor according to an embodiment of the invention.

FIGS. 1-10 illustrate an RF antenna and/or various portions of the RF antenna according to various embodiments of the invention. FIGS. 6, 8 and 10 also illustrates a coaxial wire and connections between the coaxial wire and the RF antenna according to an embodiment of the invention.

The RF antenna 10 includes:

a. A hollow enclosure 20 made of a conductive and durable material. A first portion 22 of the hollow enclosure has a bow tie shaped slot 30. A second portion 21 of the hollow enclosure 20 has a first aperture 27.

b. A conductor (denoted 40 in FIGS. 2, 3, 4 and 6) that is spaced apart from the slot 30, is positioned within a cavity (denoted 28 in FIGS. 1-4) defined by the hollow enclosure 20, and is electrically isolated from the conductor 40.

c. A first port (denoted 50 in FIGS. 2-4 and 6) that is at least partially included in the first aperture and is coupled to the conductor 40.

d. A dielectric element (denoted 60 in FIG. 3) that is made of dielectric material that at least partially fills the cavity and the bow tie shaped slot. According to an embodiment of the invention the dielectric material surrounds the conductor and completely fills the cavity and the bow tie shaped slot 30.

When the RF antenna operates as a receive antenna the conductor 40 may receive, via the cavity, received RF radiation and send a received RF signal to the first port. When the RF antenna operates as a transmit antenna the conductor 40 may (b) receive, from the first port, a transmitted RF signal and radiating transmitted RF radiation via the cavity.

The dielectric material may be made of materials such as but not limited to Pure Teflon, ABS, Delrin, refactory clay, ceramic or vermiculum. The dielectric material permits shrinkage of the cavity because the effective wavelength inside the material is the nominal wavelength in air divided by the square root of the dielectric constant. For example, if the material has a dielectric constant of 2.1 (pure Teflon), the size shrinks by a factor of 1.45. Furthermore, the dielectric material inside the cavity contributes to the stiffness of the cavity.

FIGS. 1-4 and FIG. 7 illustrate various stages of an assembly process of the RF antenna.

FIG. 1 illustrates a first phase of the assembly process in which the hollow enclosure 20 is empty.

Figure 2:
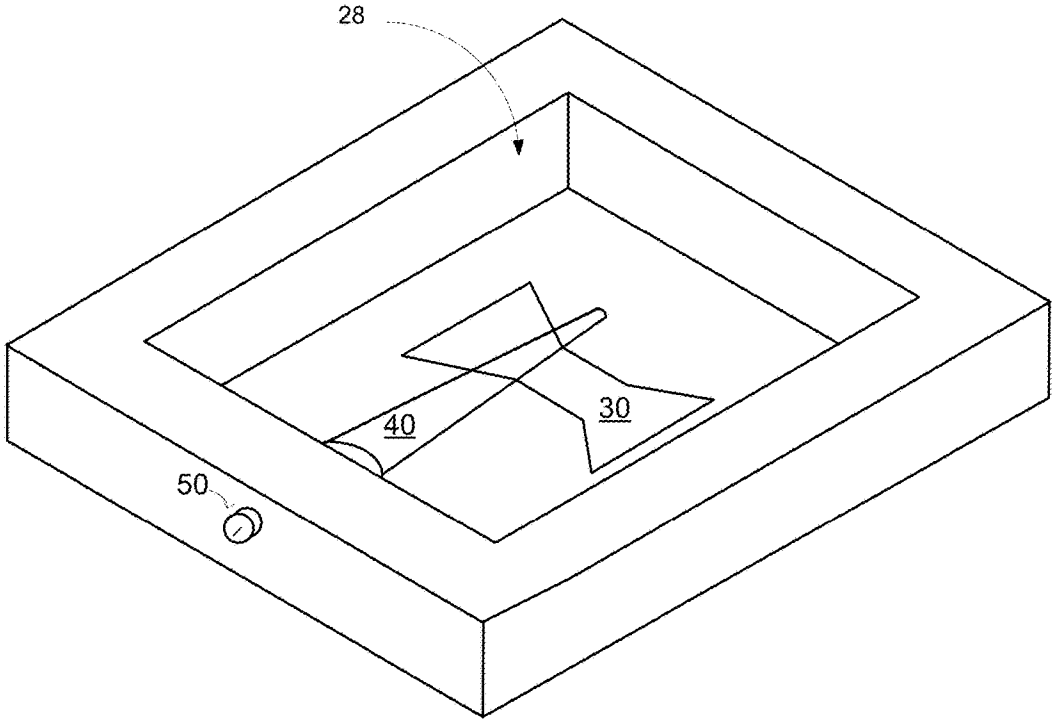
FIG. 2 illustrates portion of a RF antenna that includes a portion of the hollow enclosure, a first port and a conductor according to an embodiment of the invention.

The assembly process may continue by placing dielectric material 61 that partially fills the cavity (see the upper section of FIG. 7) and/or by connecting the conductor 40 (see the intermediate section of FIG. 7 and FIG. 2). FIG. 2 illustrates the conductor 40 and the hollow enclosure 20 but does not illustrate any dielectric material.

Figure 3:
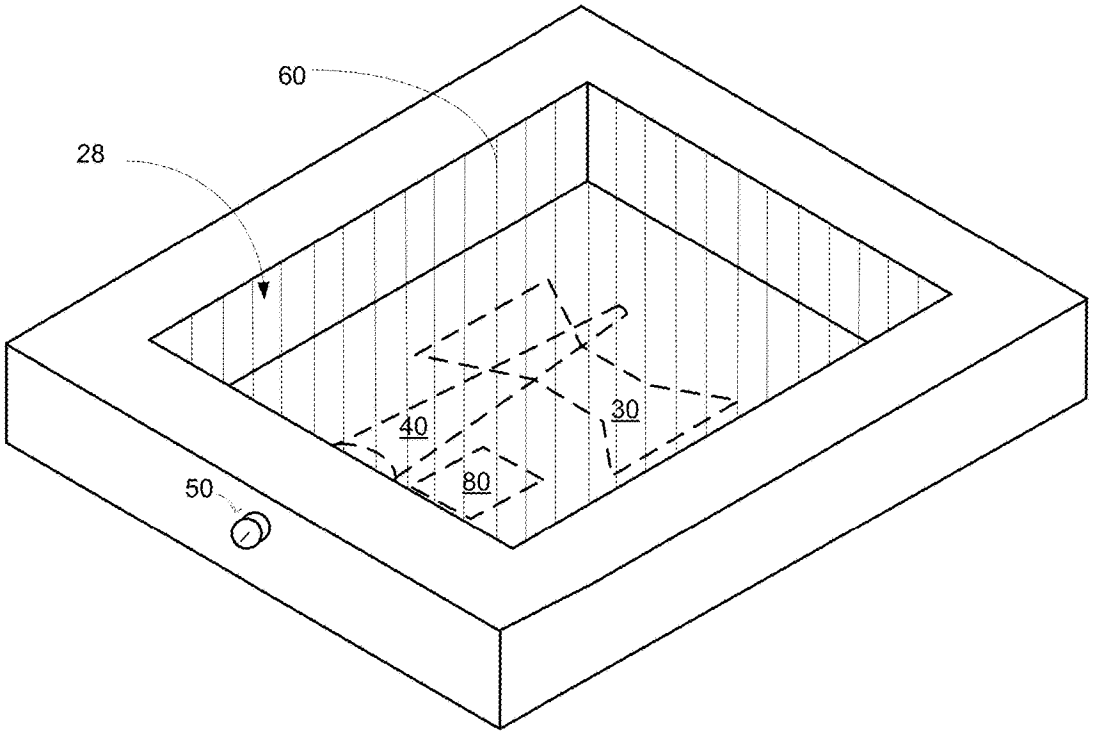
FIG. 3 illustrates portion of a RF antenna that includes a portion of the hollow enclosure, a first port, a conductor and a conductive element that fills a cavity defined by the hollow enclosure according to an embodiment of the invention.

Yet another phase of the assembly process may include filling the entire cavity with dielectric material (FIG. 3) and closing the cavity (for example by fastening facet 26 to sidewalls 21, 23, 24 and 25)—as illustrated by FIG. 4 and the lower section of FIG. 7.

Finally—a coaxial conductor may be connected to an input port that is also connected to the hollow enclosure (see, for example FIG. 6).

FIGS. 1-4 and 8 illustrate a rectangular shaped hollow enclosure 20. It includes a bottom facet 22, four sidewalls 21, 23, 24 and 25 and a top facet (denoted 26 in FIGS. 4 and 7). It is noted that the hollow enclosure may be of any other shapes.

The RF antenna may have cavity dimensions which are much smaller than would be expected from slotted waveguide antennas. This reduction in dimensions may be attributed to the structure of the RF antenna and especially can be attributed to the manner in which RF signals are provided to the bow tie shaped slot.

A non-limiting example of the dimensions of cavity 28 are (see FIG. 1) height Hc 20 mm, width Wc 80 mm and length Lc 110 mm. The thickness of the sidewalls 21, 23, 24 and 25 and of facets 22 and 26 are 10 mm.

Yet another non-limiting example of the dimensions of the hollow enclosure is height $0.1\cdot\lambda$, width $0.3\cdot\lambda$ and length $0.3\cdot\lambda$ respectively. For example, for operating with a RF radiation having a 30 cm wavelength (equivalent to frequency 1000 MHz) the size of the hollow enclosure might be 3×9×9 cm.

The specific size of the bow tie shaped slot may be designed to optimize its performance, while the RF antenna is directed to the ground, and the physical properties of a typical soil are taken into account (dielectric constant 4-20, and conductivity 0.001-0.05 Siemens/meter).

Referring to FIG. 5—the bow tie shaped slot 30 includes a central portion 32 and two exterior portions 31 and 33 that are located at both opposing ends of the central portion 32. The exterior portions 31 and 33 have uneven widths—the width of each exterior portion of the slot may expand when getting further from the central portion. This expansion may be symmetrical, asymmetrical, gradual and/or non-gradual. The width expansion occurs along a longitudinal axis such as longitudinal axis of symmetry (denoted LSY) 34 of the bow tie shaped slot 30. FIG. 5 also illustrates a traverse axis of symmetry 35 that is located at the center of the central portion 32. The bow tie shaped slot 30 has a length L1 a width W1, the central portion 32 has a length L2 and the central portion 32 has a width W2. In FIG. 5 the length of each one of the exterior portions 31 and 33 is (W1−W2)/2 and the width of one of the exterior portions 31 and 33 is (L1−L2)/2.

Non limiting examples of values of the bow tie shaped slot are L1=99.7 mm, L2=20.2 mm, W1=33.5 mm, and W2=13.5 mm.

The bow tie shape of the slot provides a large fractional bandwidth—for example a bandwidth of about 50% from a carrier frequency of the RF signal received or transmitted by/from the RF antenna.

The bow tie shaped slot 30 may have one or more rounded edges and/or facets, and may be shaped as a polygon.

According to an embodiment of the invention the exact shape and dimensions of the bow tie shaped slot may be determined in a trial and error method using finite elements (FE) simulations.

FIGS. 2-4 and 6 illustrate that the bow tie shaped slot 30 is positioned below (and without contact) with the conductor 40, wherein the conductor 40 is positioned normal to and at the center of the bow tie shaped slot 30. It is noted that the angle between the conductor 40 and the bow tie shaped slot may differ from ninety degrees and that the conductor 40 may be positioned above the center of the bow tie shaped slot or positioned elsewhere—in deviation from the traverse center of symmetry of the bow tie shaped slot.

The conductor 40 may be positioned anywhere within the cavity while not contacting the hollow enclosure. It may, for example, be positioned at the middle of the height of any sidewall of the hollow enclosure or be closer to one facet out of facets 22 and 26. The exterior of the conductor may be positioned between 1 mm and half the heights from one of the facets 22 and 26.

Unlike regular slot antennas in which the slot is fed by a voltage source across its center opening, so that a symmetric potential difference is created between its edges, in RF antenna 10 the conductor 40 is thick in relation to the core 91 of coaxial cable 90 and may have a cross-section, whose principal dimension (denoted 41 in FIG. 6) could be as much as half of the inner thickness of the dielectric material within cavity 26 and may be adapted optimally to complement the slot shape.

In FIGS. 2-4 and 7 the conductor 40 is illustrated as having an almost conical shape—having a biggest cross section at a point nearest to sidewall 21 and having a smallest cross section at an opposite end—at a point that is most distant from sidewall 21. It is noted that the conductor may have other shapes. For example—the conductor 40 may have its biggest cross section at a point that differs from the closest point to the sidewall, may have a portion in which the cross section increases with the distance from the sidewall, may have different portions that differ from each other by the relationship between the size of the cross section and the distance from the sidewall.

In these figures, the cross section of the conductor 40 gradually decreases with the distance from sidewall 21. In FIG. 9 the conductor 40 is shown as having a first portion 45 and a second portion 44, wherein the first portion 45 is closer to sidewall 21 and has a height that is substantially constant while the height of the second portion 44 gradually decreases.

The shape of the conductor 40 may facilitate optimal feeding of the bow tie shaped slot 30 over a wide frequency range. The smaller sized cross section (denoted 42 in FIG. 9) is derived to support the highest desirable frequency, and the larger sized cross section (denoted 43 in FIG. 9) is derived to support the lowest desirable frequency.

The decreasing function of the cross section of the conductor may be determined in a trial and error method using finite element (FE) simulations.

The cross section of the conductor 40 may decrease almost monotonically. The cross-section of the conductor might be elliptical (as illustrated in FIG. 6) and not circular to support further reduction of the vertical size of the hollow enclosure. It is noted that the shape of the cross section may differ from a circle and differ from an ellipse. For example—the cross section may be a polygon such as a rectangle, a triangle or have more than five facets. The cross section may have linear portions as well as non-linear portions. The shape of the cross section may be the same throughout the conductor but may change.

The conductor 40 may be partially or completely buried in the dielectric material. FIGS. 3, 4 and 7 illustrate the conductor as being completely buried within the dielectric material. FIG. 7 illustrates an assembly process in which a first dielectric layer 61 is positioned within the cavity and above facet 22 in which the bow tie shaped slot 30 is formed.

To simplify the simulations to determine the decreasing cross section of the conductor, and the vertical distance between the bow tie shaped slot and the conductor, the conductor is assumed to be positioned orthogonally to the longitudinal symmetry axis of the bow tie shaped slot and from a top view may be viewed as being just beneath to midpoint of the slot.

Other installation, namely, not necessarily orthogonal to and in the middle of the slot, could be used. However, adding degrees of freedom, while enabling potential improvement, might significantly increase simulations complexity. Due to fabrication tolerances and tooling considerations, the exact position, shape and dimensions are determined in a trial and error method using simulations and modelling.

FIG. 10 illustrates the input port 50 that has a core 51 (shown in FIG. 6) that extends through sidewall 21 and is electrically coupled to intermediate conductor 70 that is also coupled to conductor 40. The core 51 is isolated from the sidewall 21 by isolating element 53.

FIGS. 6 and 8 illustrate a connection between the coaxial cable 90 and the RF antenna 10 according to various embodiments of the invention. FIGS. 6 and 8 illustrate an example of a manner in which a core 91 of coaxial cable 90 is electrically coupled (via core 51 of first port 50) and an intermediate conductor 70 to the conductor 40 while the shield 52 of the coaxial cable 90 is electrically coupled (via the shield 52 of first port) to the hollow enclosure 20. The shield 52 is made of a conductive material.

The conductor 40 and the hollow enclosure may be stimulated by alternating voltage and the field configuration set up between them induces current in the bow tie shaped slot walls so that a balanced feed (BALUN) is not required. This assists in achieving the large bandwidth potential of the RF antenna while simultaneously promoting compactness, since a wideband balun would be inconveniently large.

Therefore a regular coaxial port, which is unbalanced, can be coupled to the conductor with no special balun.

A balun is often of order $0.25\cdot\lambda$–$0.5\cdot\lambda$, namely 7.5-15 cm for 1,000 MHz frequency, so that avoiding a balun maintains the RF antenna compact, with minimal wiring inside, so that the stiffness and manufacturing simplicity is improved.

By the mentioned above coupling the conductor 40 is electrically isolated from the hollow enclosure. An RF transmitter that is coupled to the coaxial cable 90 may be configured to excite potential difference between the hollow enclosure and the conductor.

As there is no direct contact between the conductor 40 and the sidewalls of the hollow enclosure 20, there is an induction effect in the hollow enclosure (like an antenna in an antenna), which stimulates the bow tie shaped slot indirectly.

Yet according to an embodiment of the invention the RF antenna may include (or may be coupled to) an antenna monitor that is arranged to monitor at least one out of a location of the RF antenna, a velocity of the RF antenna and an acceleration of the RF antenna. For example—the antenna monitor may measure up till six degrees of freedom—locations in X, Y and Z axes as well as rotation in $\theta$, $\Psi$ and $\Phi$. All may be measured as functions of time as a parameter and related to radar time when used in conjunction with a radar sensor.

FIG. 3 illustrates an antenna monitor 80 that is located within the cavity 28 but the antenna monitor may be located outside the cavity.

The antenna monitor 80 may be an inertial measurement unit (IMU), an attitude and heading reference system (AHRS), an attitude heading and reference system or an airborne heading-attitude reference system (AHARS).

The RF antenna 10 may be embedded in a digging element that is used to dig materials.

According to an embodiment of the invention there may be provided an RF front end that includes a receive RF antenna and a transmit RF antenna. Both receive and transmit RF antennas may be the same or may differ from each other by at least one characteristic such as size, shape, materials, orientation, polarization and the like. For example—the receive and transmit RF antennas may be arranged to be cross polarized for radar reasons or to minimize leakage between them.

The receive and transmit RF antennas may be mounted end to end, may be close to each other (distance between the antennas is smaller than their length, height and/or width) or spaced apart from each other.

The receive and transmit RF antennas may be identical, not identical, nor symmetrically positioned, and the actual position and size might be determined, for example, to gain low mutual coupling between the antennas.

These may be positioned to provide an optimal fit to the ambient medium and to address mechanical considerations.

Figure 11:
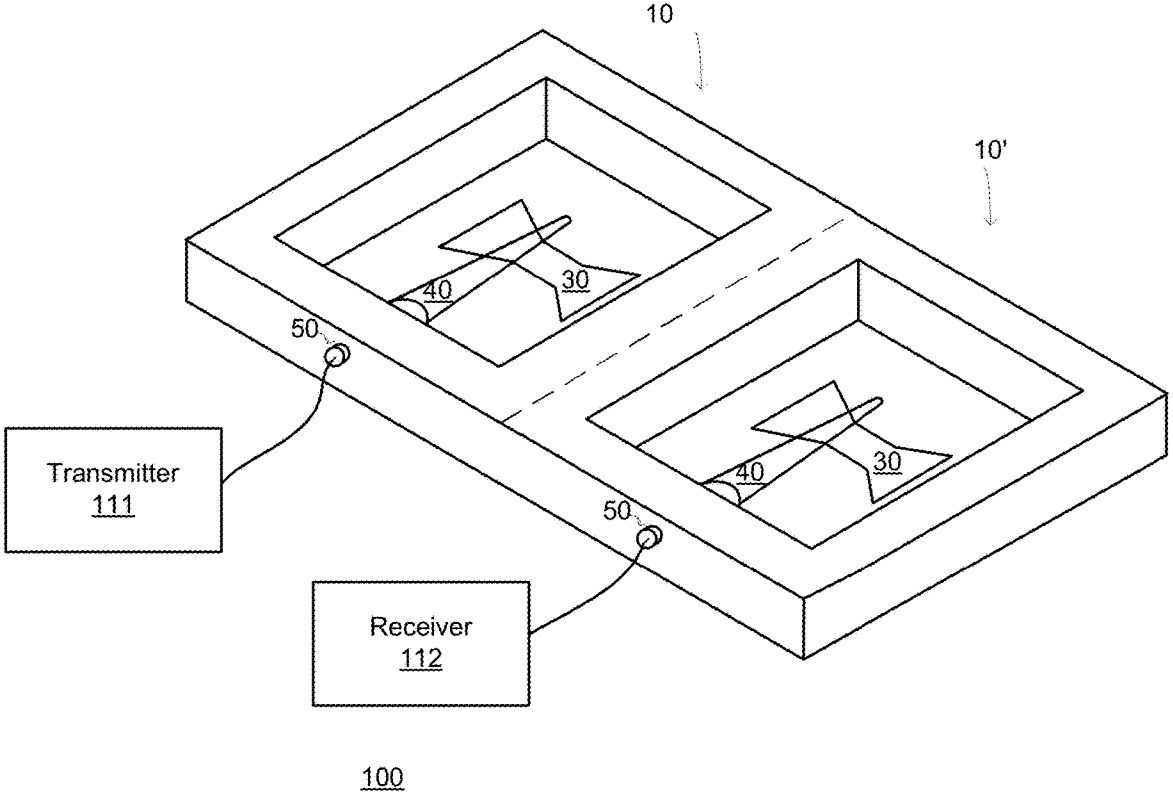
FIG. 11 illustrates a portion of system that includes integrated two RF antennas according to an embodiment of the invention.
Figure 12:
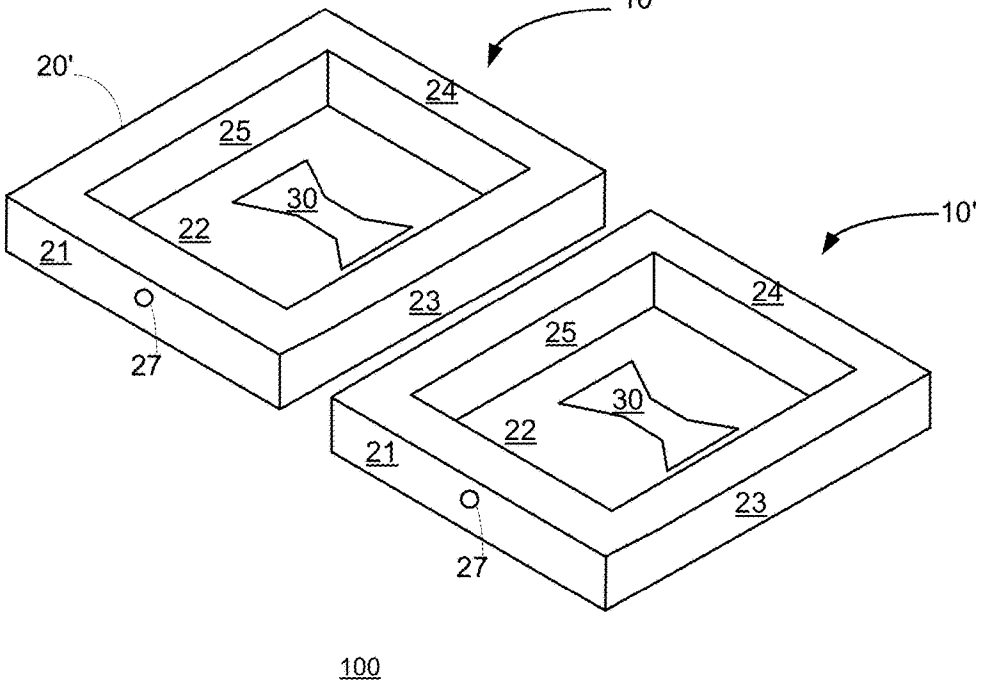
FIG. 12 illustrates a portion of system that includes two spaced apart RF antennas according to an embodiment of the invention.

For example, in the two antenna structure in FIG. 11, the dimensions of the intermediate conductor 40 may be approximately: $0.1\cdot\lambda\times0.3\cdot\lambda\times0.6\cdot\lambda$. For example, if the wavelength is 20 cm (at frequency 1500 MHz), the size of the two antennas including the walls might be as much as 4×8×16 cm.

Also, when the RF antenna is affixed to the bucket, the position of the antenna, as an alternative to using the IMU monitor, could be inferred using measurement means installed within the joints of the digging arm, e.g., rotary encoders.

In the foregoing specification, the invention has been described with reference to specific examples of embodiments of the invention. It will, however, be evident that various modifications and changes may be made therein without departing from the broader spirit and scope of the invention as set forth in the appended claims.

Figure 13:
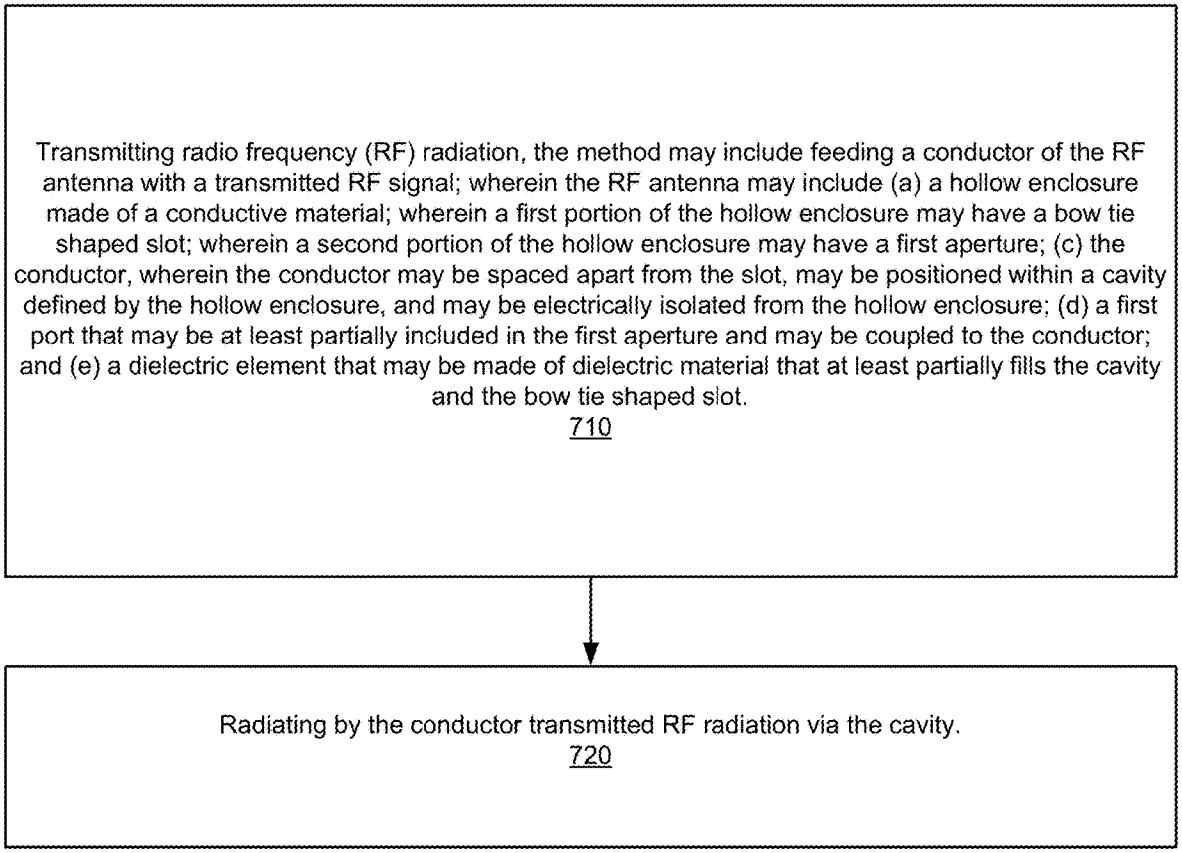
FIG. 13 illustrates a method according to an embodiment of the invention.

FIG. 13 illustrates method 700 according to an embodiment of the invention.

Method 700 may start by stage 710 for transmitting radio frequency (RF) radiation, the method may include feeding a conductor of the RF antenna with a transmitted RF signal; wherein the RF antenna may include (a) a hollow enclosure made of a conductive material; wherein a first portion of the hollow enclosure may have a bow tie shaped slot; (c) the conductor, wherein the conductor may be spaced apart from the slot, may be positioned within a cavity defined by the hollow enclosure, and may be electrically isolated from the hollow enclosure; (d) a first port that may be coupled to the conductor; and (e) a dielectric element that may be made of dielectric material that at least partially fills the cavity and the bow tie shaped slot.

Stage 710 may be followed by stage 720 of radiating by the conductor transmitted RF radiation via the cavity.

Figure 14:
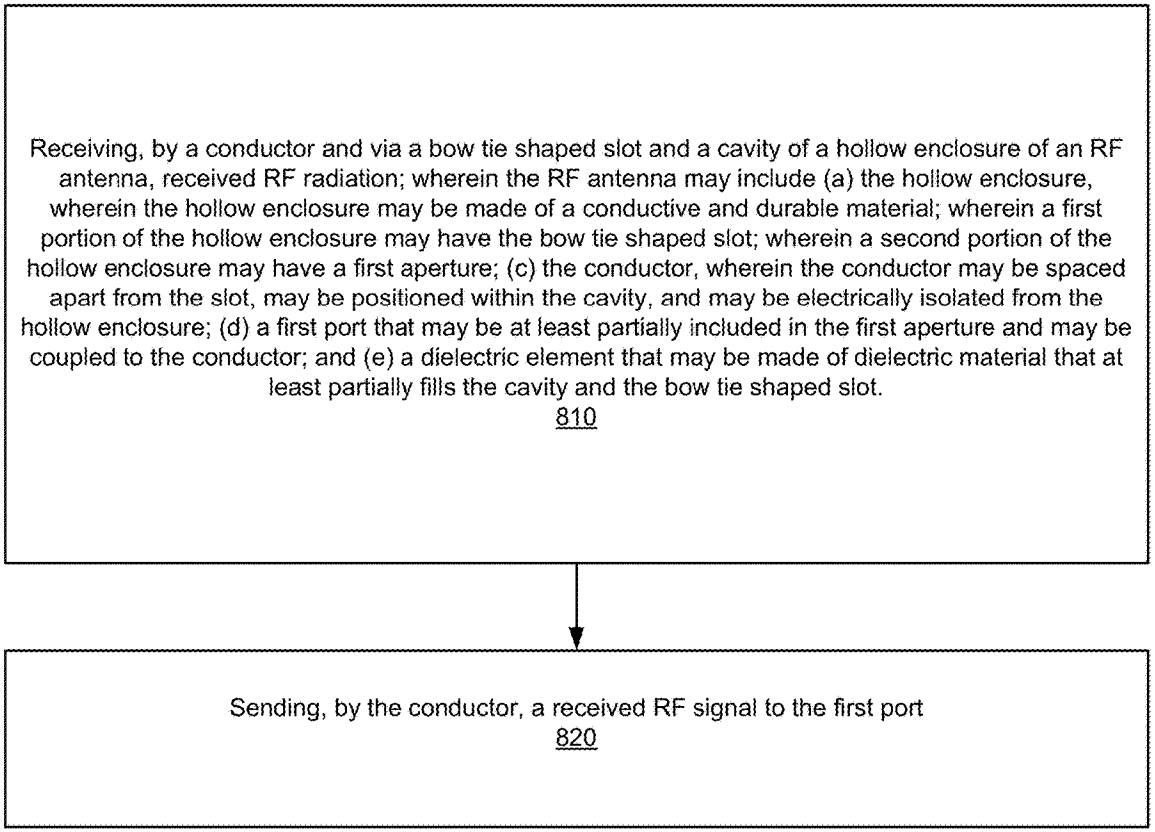
FIG. 14 illustrates a method according to an embodiment of the invention.

FIG. 14 illustrates method 800 according to an embodiment of the invention.

Method 800 may start by stage 810 of receiving, by a conductor and via a bow tie shaped slot and a cavity of a hollow enclosure of an RF antenna, received RF radiation; wherein the RF antenna may include (a) the hollow enclosure, wherein the hollow enclosure may be made of a conductive and durable material; wherein a first portion of the hollow enclosure may have the bow tie shaped slot; (c) the conductor, wherein the conductor may be spaced apart from the slot, may be positioned within the cavity, and may be electrically isolated from the hollow enclosure; (d) a first port that may be coupled to the conductor; and (e) a dielectric element that may be made of dielectric material that at least partially fills the cavity and the bow tie shaped slot.

Stage 810 may be followed by stage 820 of and sending, by the conductor, a received RF signal to the first port.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures may be implemented which achieve the same functionality.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A ground penetration radar (GPR) antenna, integrated into a digging machine such that the GPR is configured to remain operable under the same environmental conditions as the machine, comprising:

a rectangular hollow enclosure made of a conductive material defining a cavity therein;

wherein a first portion of the hollow enclosure has a bow tie shaped slot;

a conductor that is spaced apart from the slot, is positioned within said cavity, is galvanically isolated from walls of the hollow enclosure and induces an induction effect in said cavity to indirectly stimulate said slot in the UHF and L-band frequencies, wherein said conductor is an elliptical cylinder which tapers along a longitudinal axis of the conductor from a feed point;

wherein the bow tie shaped slot has a longitudinal axis and a transverse axis of symmetry;

wherein a projection of the conductor on the bow tie shaped slot overlaps the transverse axis of symmetry of the bow tie shaped slot;

a first port that is coupled to the conductor; and a dielectric element that is made of a solid dielectric material that at least partially fills the cavity and the bow tie shaped slot; said dielectric to facilitate matching of waves to and from said ground, wherein said solid dielectric encases the conductor to maintain the conductor in a location above said slot;

wherein the shape of said cavity with said dielectric, the shape of said conductor and the shape of said slot combine to provide a ground penetrating antenna.

2. The RF antenna according to claim 1 wherein the first port comprises a core that is coupled to the conductor and a shield that is coupled to the hollow enclosure.

3. The RF antenna according to claim 1 wherein the first port is configured to be coupled to a RF feed without a balun.

4. The RF antenna according to claim 1 wherein RF antenna does not include a balun.

5. The RF antenna according to claim 1 wherein a cross section of the conductor changes along at least a portion of the longitudinal axis.

6. The RF antenna according to claim 1 wherein the bow tie shaped slot has a longitudinal axis that is perpendicular to said longitudinal axis of the conductor.

7. The RF antenna according to claim 1 wherein the bow tie shaped slot has a longitudinal axis that is oriented in relation to said longitudinal axis of the conductor.

8. The RF antenna according to claim 1 wherein the dielectric material completely fills the cavity and the bow tie shaped slot.

9. The RF antenna according to claim 1 wherein a thickness of the first portion of the hollow aperture is about one tenth of a wavelength of a RF signal transmitted by the RF antenna.

10. The RF antenna according to claim 1 further comprising an antenna monitor that is arranged to monitor at least one out of a location of the RF antenna, a velocity of the RF antenna and an acceleration of the RF antenna.

11. The RF antenna according to claim 1 further comprising an antenna monitor that is arranged to monitor antenna movements in six degrees of freedom as a function of time.

12. The RF antenna according to claim 1 further comprising an antenna monitor that is positioned within the cavity.

13. The RF antenna according to claim 1 further comprising an antenna monitor that is an attitude and heading reference system or an attitude heading reference system.

14. The RF antenna according to claim 1 wherein the hollow enclosure is made of a durable material.

15. The RF antenna according to claim 1 wherein dielectric has a conformal shape to said conductor within which said conductor sits.

16. A method for transmitting radio frequency (RF) radiation which penetrates into the ground from a ground penetrating antenna (GPR) integrated into a digging machine such that the GPR is configured to remain operable under the same environmental conditions as the machine, the method comprises:

feeding a conductor of the RF antenna with a transmitted RF signal;

wherein the RF antenna comprises a rectangular hollow enclosure made of a conductive material defining a cavity therein;

wherein a first portion of the hollow enclosure has a bow tie shaped slot;

wherein said conductor is spaced apart from the slot, is positioned within said cavity, is galvanically isolated from walls of the hollow enclosure and induces an induction effect in said cavity to indirectly stimulate said slot in the UHF and L-band frequencies, wherein said conductor is an elliptical cylinder which tapers along a longitudinal axis of the conductor from a feed point;

maintaining said conductor in location above said slot via an encasing, solid dielectric, wherein said dielectric at least partially fills the cavity and the bow tie shaped slot and is selected to facilitate efficient matching of said RF signal to said ground;

wherein the bow tie shaped slot has a longitudinal axis and a transverse axis of symmetry;

wherein a projection of the conductor on the bow tie shaped slot overlaps the transverse axis of symmetry of the bow tie shaped slot;

wherein the shape of said cavity with said dielectric, the shape of said conductor and the shape of said slot combine to provide a ground penetrating antenna.

17. A method for transmitting radio frequency (RF) radiation from an object in the ground from a ground penetrating antenna (GPR) integrated into a digging machine such that the GPR is configured to remain operable under the same environmental conditions as the machine, the method comprises:

receiving, by a conductor and via a bow tie shaped slot and a cavity of a rectangular hollow enclosure of an RF antenna, received RF radiation; wherein the RF antenna comprises the hollow enclosure, wherein the hollow enclosure is made of a conductive material defining a cavity therein;

wherein a first portion of the hollow enclosure has the bow tie shaped slot; and said conductor is an elliptical cylinder which tapers along a longitudinal axis of the conductor from a feed point;

galvanically isolating said conductor from the hollow enclosure and inducing an induction effect in said cavity to indirectly stimulate said slot in the UHF and L-band frequencies;

maintaining said conductor in location spaced apart and above said slot via an encasing, solid dielectric wherein said dielectric at least partially fills the cavity and the bow tie shaped slot and is selected to facilitate efficient matching of said RF signal to said ground;

wherein the bow tie shaped slot has a longitudinal axis and a transverse axis of symmetry;

wherein a projection of the conductor on the bow tie shaped slot overlaps the transverse axis of symmetry of the bow tie shaped slot;

wherein the shape of said cavity with said dielectric, the shape of said conductor and the shape of said slot combine to provide a ground penetrating antenna.

* * * * *